US010144437B2

(12) United States Patent
Yin et al.

(10) Patent No.: US 10,144,437 B2
(45) Date of Patent: Dec. 4, 2018

(54) SWING BOLSTER, SWING BOLSTER VIBRATION REDUCTION ASSEMBLY AND BOGIE

(71) Applicants: CRRC Qiqihar Co. Ltd. Dalian Research & Development Center, Dalian, Liaoning (CN); CRRC Qiqihar Rolling Stock Co., Ltd., Qiqihar, Heilongjiang (CN)

(72) Inventors: Pinwei Yin, Qiqihar (CN); Shifeng Xu, Qiqihar (CN); Zhenming Liu, Qiqihar (CN); Derong Zhang, Qiqihar (CN); Hao Liang, Qiqihar (CN)

(73) Assignees: CRR Qigihar Co., Ltd. Dalian Research & Development Center, Dalian (CN); CRRC Qigihar Rolling Stock Co., Ltd., Qigihar (CN)

( * ) Notice: Subject to any disclaimer, the term of this patent is extended or adjusted under 35 U.S.C. 154(b) by 317 days.

(21) Appl. No.: 14/648,744

(22) PCT Filed: Jun. 27, 2014

(86) PCT No.: PCT/CN2014/081020

§ 371 (c)(1),
(2) Date: Jun. 1, 2015

(87) PCT Pub. No.: WO2015/078180

PCT Pub. Date: Jun. 4, 2015

(65) Prior Publication Data

US 2015/0367866 A1 Dec. 24, 2015

(30) Foreign Application Priority Data

Nov. 27, 2013 (CN) ..... 2013 1 0617318

(51) Int. Cl.
*B61F 5/00* (2006.01)
*B61F 5/06* (2006.01)
(Continued)

(52) U.S. Cl.
CPC ..... *B61F 5/06* (2013.01); *B61F 5/12* (2013.01); *B61F 5/122* (2013.01); *B61F 5/18* (2013.01)

(58) Field of Classification Search
CPC .... B61F 5/122; B61F 5/06; B61F 4/06; B61F 4/122; B61F 4/18; B61F 4/12
(Continued)

(56) References Cited

U.S. PATENT DOCUMENTS 2,424,936 A * 7/1947 Light ..... B61F 5/12
105/198.5
2,485,973 A * 10/1949 Lehrman ..... B61F 5/122
105/198.4
(Continued)

FOREIGN PATENT DOCUMENTS

| | | |
|---|---|---|
| CN | 103612645 A | 3/2014 |
| GB | 1114434 | 5/1968 |
| WO | WO 2015/0178180 | 6/2015 |

OTHER PUBLICATIONS

Australian Government, Patent Examination Report No. 1, for Patent Application No. 201435718, dated Nov. 12, 2015.
New Zealand Intellectual Property Office, First Examination Report, for Patent application No. 708666, dated Aug. 3, 2016.
Russian Federation, Examiantion Report, for Patent Applciation No. dated Feb. 21, 2017.
(Continued)

*Primary Examiner* — Robert J McCarry, Jr.
*Assistant Examiner* — Scott A Browne
(74) *Attorney, Agent, or Firm* — Porter, Wright, Morris & Arthur, LLP

(57) ABSTRACT

The disclosure discloses a swing bolster, a swing bolster vibration reduction assembly and a bogie. The swing bolster includes a body, wherein a mounting cavity for mounting a
(Continued)

friction block is formed in two ends of the body; the mounting cavity is provided with a first horizontal opening and a second horizontal opening, which are opposite to each other; and opening directions of the first horizontal opening and the second horizontal opening are perpendicular to an extending direction of the body. When the swing bolster in the disclosure is used, the friction block is mounted in the mounting cavity of the swing bolster body, and end parts of the friction block extend out of the first horizontal opening and second horizontal opening of the mounting cavity. The friction block is not matched with the swing bolster through sloped portions, and a movement direction of the swing bolster is perpendicular to a movement direction of the friction block relative to the swing bolster, so that wear of the friction block and the swing bolster is reduced, influence caused by the relative movement or wear of the swing bolster and the friction block to vibration reduction performance of the vertical elastic elements is prevented, a vibration reduction effect of the bogie in an unloaded state is ensured, and using reliability of the swing bolster is ensured.

16 Claims, 2 Drawing Sheets

(51) Int. Cl.
*B61F 5/12* (2006.01)
*B61F 5/18* (2006.01)

(58) Field of Classification Search
USPC .... 105/197.05, 198.2, 198.4, 200, 201, 207, 105/208, 198.5
See application file for complete search history.

(56) References Cited

U.S. PATENT DOCUMENTS

| | | | | | |
|---|---|---|---|---|---|
| 2,485,974 | A | | 10/1949 | Lehrman | |
| 2,528,473 | A | * | 10/1950 | Kowalik | B61F 5/122 105/198.5 |
| 2,615,403 | A | | 10/1952 | Orr et al. | |
| 2,660,129 | A | * | 11/1953 | Wulff | B61F 5/122 105/198.5 |
| 2,669,944 | A | * | 2/1954 | Spenner | B61F 5/122 105/198.5 |
| 2,687,295 | A | | 8/1954 | Tucker | |
| 2,720,172 | A | | 10/1955 | Baselt | |
| 2,747,518 | A | | 5/1956 | Campbell | |
| 2,905,106 | A | | 9/1959 | Carlson | |
| 3,575,117 | A | * | 4/1971 | Tack | B61F 5/122 105/193 |
| 3,654,870 | A | * | 4/1972 | Wallace | B61F 5/06 105/198.4 |
| 3,716,903 | A | * | 2/1973 | Tack | B61F 5/06 105/198.5 |
| 4,167,907 | A | | 9/1979 | Mulcahy et al. | |
| 4,244,298 | A | | 1/1981 | Hawthorne et al. | |
| 4,357,880 | A | * | 11/1982 | Weber | B61F 5/34 105/197.05 |
| 5,875,721 | A | * | 3/1999 | Wright | B61F 5/12 105/198.2 |
| 8,104,409 | B2 | * | 1/2012 | Wolinski | B61F 5/06 105/182.1 |
| 2010/0043668 | A1 | * | 2/2010 | Wolinski | B61F 5/122 105/198.4 |
| 2014/0102330 | A1 | * | 4/2014 | Gotlund | B61F 5/122 105/198.2 |

OTHER PUBLICATIONS

SIPO, Search Report, Patent Application No. 201310617318X.

* cited by examiner

SWING BOLSTER, SWING BOLSTER VIBRATION REDUCTION ASSEMBLY AND BOGIE

TECHNICAL FIELD OF THE INVENTION

The disclosure relates to the technical field of bogies, and in particular to a swing bolster, a swing bolster vibration reduction assembly and a bogie.

BACKGROUND OF THE INVENTION

A cast steel three-piece bogie is the most common bogie type in a rail wagon.

As shown in FIG. 1, a bogie in prior art comprises a body 10' of a swing bolster, friction blocks 20', vertical elastic elements 40', upright post wearing plates 70', slope wearing plates 90' and a side frame 80', wherein there are two friction blocks 20, the body 10' of the swing bolster is matched with the two friction blocks 20' through sloped portions, and the body 10' of the swing bolster is positioned between the two friction blocks 20', the slope wearing plates 90' are arranged on the body 10' of the swing bolster, and each of the slope wearing plates 90' is positioned between the body 10' of the swing bolster and each of the friction blocks 20'; the upright post wearing plates 70' are in friction fit with the friction blocks 20'; the vertical elastic elements 40' are arranged below the body 10' of the swing bolster and the friction blocks 20', and the body 10' of the swing bolster, the friction blocks 20', the vertical elastic elements 40', the upright post wearing plates 70' and the slope wearing plates 90' are all arranged on the side frame 80'.

The weight of a wagon body acts on the vertical elastic elements 40' through the body 10' of the swing bolster, the vertical elastic elements 40' are used for alleviating impact force from a rail and disturbing force of vibration, and a function of preventing system vibration is realized because the direction of acting force of the vertical elastic elements 40' is opposite to its movement direction. Meanwhile, under the action of acting force of the wagon body and counter-force of springs, certain pressure may be generated between the upright post wearing plates 70' and the friction blocks 20' and between the slope wearing plates 90' and the friction blocks 20'. In a vibration process of the wagon body, relative movement and friction may be produced between the upright post wearing plates 70' and the friction blocks 20' and between the slope wearing plates 90' and the friction blocks 20', so that vibration kinetic energy is converted into friction heat energy to fulfil the aim of reducing the vibration and impact of a wagon.

The slope wearing plates 90' may be thinned after long-term friction between the body 10' of the swing bolster and the friction blocks 20', which causes the upward movement of the friction blocks 20' to further reduce compression amounts of the vertical elastic elements 40' and namely reduce vibration reduction capabilities of the vertical elastic elements 40'. Particularly during unloaded running of the bogie, the compression amounts of the vertical elastic elements 40' are small, so that a poor vibration reduction effect and a potential running safety hazard during the unloaded running of the bogie are caused.

SUMMARY OF THE INVENTION

A purpose of the disclosure is to provide a swing bolster, a swing bolster vibration reduction assembly and a bogie, so as to solve the problem of influence of high wear of a swing bolster and friction blocks on the vibration reduction effect of vertical elastic elements in the prior art.

In order to solve the technical problem, according to an aspect of the disclosure, a swing bolster is provided, which comprises a body, wherein a mounting cavity for mounting a friction block is formed in two ends of the body; the mounting cavity is provided with a first horizontal opening and a second horizontal opening, which are opposite to each other; and opening directions of the first horizontal opening and the second horizontal opening are perpendicular to an extending direction of the body.

Furthermore, the body is provided with: a first vertical hole, the first vertical hole is in communication with the mounting cavity; and a second vertical hole, the second vertical hole is in communication with the mounting cavity, the second vertical hole and the first vertical hole being coaxially formed, a part of the friction block being arranged in the first vertical hole and the second vertical hole in a sliding manner.

Furthermore, a diameter of the first vertical hole is greater than that of the second vertical hole.

According to another aspect of the disclosure, a swing bolster vibration reduction assembly is provided, which comprises a swing bolster and a vibration reduction unit, wherein the swing bolster is the abovementioned swing bolster; a body of the swing bolster is provided with a first vertical hole, and the first vertical hole is in communication with a mounting cavity; the vibration reduction unit comprises a friction block, a horizontal elastic element and vertical elastic elements; the friction block comprises: a first friction block, the first friction block being arranged in the mounting cavity of the swing bolster, a first end of the first friction block extending from a first horizontal opening of the mounting cavity; a second friction block, the second friction block being arranged in the mounting cavity of the swing bolster, the second friction block being positioned in an extending direction of the first friction block, a first end of the second friction block extending from a second horizontal opening of the mounting cavity, the horizontal elastic element being arranged between the first friction block and the second friction block; a middle wedge, the middle wedge being arranged in the mounting cavity of the swing bolster, the middle wedge being positioned between the first friction block and the second friction block, the middle wedge being matched with the first friction block and the second friction block through sloped portions, a bottom end of the middle wedge extending from the first vertical hole; and there are multiple vertical elastic elements, the multiple vertical elastic elements are arranged below the swing bolster, and at least one vertical elastic element is positioned under the bottom end of the middle wedge.

Furthermore, the horizontal elastic element comprises: a first horizontal elastic element, the first horizontal elastic element being arranged between the first friction block and the middle wedge in a pressing manner; and a second horizontal elastic element, the second horizontal elastic element being arranged between the second friction block and the middle wedge in the pressing manner.

Furthermore, the body of the swing bolster is provided with a pressing plate, the pressing plate is arranged in the mounting cavity, the pressing plate and the middle wedge are arranged at an interval, and the horizontal elastic element comprises: a first horizontal elastic element, the first horizontal elastic element being arranged between the first friction block and the pressing plate in the pressing manner; and a second horizontal elastic element, the second horizontal elastic element being arranged between the second friction block and the pressing plate in the pressing manner.

Furthermore, the first friction block is provided with a first accommodation cavity, an opening of the first accommodation cavity faces the second friction block, and at least a part of the first horizontal elastic element is positioned in the first accommodation cavity; and the second friction block is provided with a second accommodation cavity, an opening of the second accommodation cavity faces the first friction block, and at least a part of the second horizontal elastic element is positioned in the second accommodation cavity.

Furthermore, the body of the swing bolster is provided with a second vertical hole, the second vertical hole is in communication with the mounting cavity, the second vertical hole and the first vertical hole are coaxially formed, and two ends of the middle wedge are arranged in the first vertical hole and the second vertical hole in a sliding manner.

Furthermore, the vibration reduction unit further comprises: a friction sleeve, the friction sleeve being provided with a first hole for the middle wedge to pass, the friction sleeve being arranged at the second vertical hole, a top end of the middle wedge being connected with the second vertical hole of the swing bolster through the friction sleeve in a sliding manner; and a stopping sleeve, the stopping sleeve being provided with a second hole for the middle wedge to pass, the stopping sleeve being arranged at the first vertical hole, the bottom end of the middle wedge extending from the second hole of the stopping sleeve, the stopping sleeve being provided with a flange for stopping the middle wedge.

Furthermore, the vibration reduction unit further comprises a upright post wearing plate, there are two upright post wearing plates, the upright post wearing plates are fixedly arranged, one upright post wearing plate of the two upright post wearing plates is pressed against a first end of the first friction block, and the other upright post wearing plate of the two upright post wearing plates is pressed against the first end of the second friction block.

According to another aspect of the disclosure, a bogie is provided, which comprises a side frame and a swing bolster vibration reduction assembly, wherein the swing bolster vibration reduction assembly is arranged on the side frame, and the swing bolster vibration reduction assembly is the abovementioned swing bolster vibration reduction assembly.

In the disclosure, the mounting cavity for mounting the friction blocks are formed in two ends of the body of the swing bolster, the mounting cavity are provided with the first horizontal opening and the second horizontal opening, which are opposite to each other, and the opening directions of the first horizontal opening and the second horizontal opening are perpendicular to the extending direction of the body. When the swing bolster in the disclosure is used, the friction block is mounted in the mounting cavity of the body of the swing bolster, and end parts of the friction block extend out of the first horizontal opening and second horizontal opening of the mounting cavity. The friction block is not matched with the swing bolster through sloped portions, and a movement direction of the swing bolster is perpendicular to a movement direction of the friction block relative to the swing bolster, so that wear of the friction block and the swing bolster is reduced, influence caused by the relative movement or wear of the swing bolster and the friction block to vibration reduction performance of the vertical elastic elements is prevented, a vibration reduction effect of the bogie in an unloaded state is ensured, and using reliability of the swing bolster is ensured.

BRIEF DESCRIPTION OF THE DRAWINGS

The drawings forming a part of the disclosure are used to provide further understanding of the disclosure, and schematic embodiments and their descriptions of the disclosure are adopted to explain the disclosure and not intended to properly limit the disclosure. In the drawings.

Figure 1:
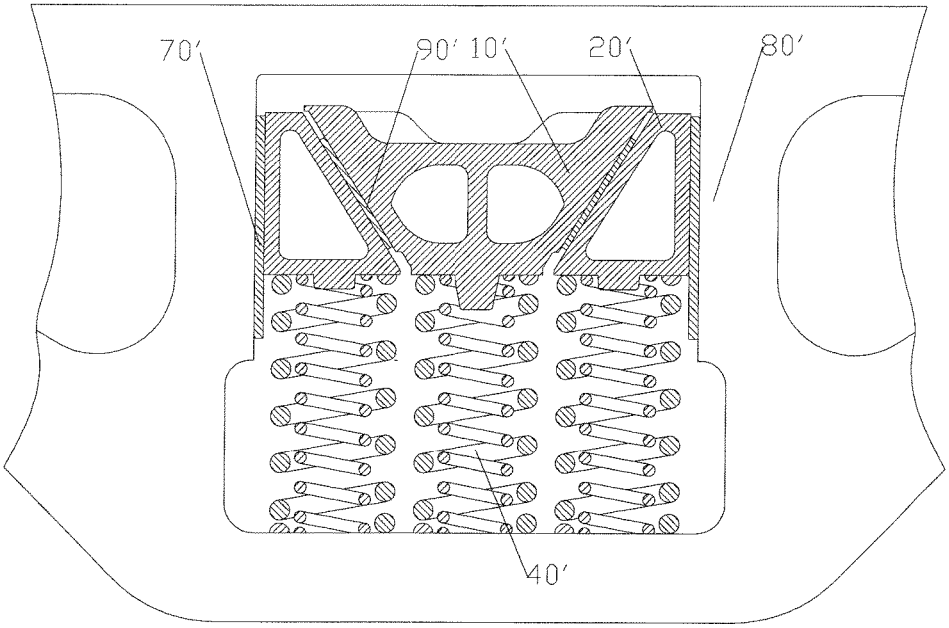
Fig. 1 PRIOR ART
FIG. 1 schematically shows a structure diagram of a bogie in the prior art.

References in the drawings: 10. body; 11. mounting cavity; 11*a*. first horizontal opening; 11*b*. second horizontal opening; 12. first vertical hole; 13. second vertical hole; 20. friction block; 21. first friction block; 21*a*. first accommodation cavity; 22. second friction block; 22*a*. second accommodation cavity; 23. middle wedge; 30. horizontal elastic element; 31. first horizontal elastic element; 32. second horizontal elastic element; 40. vertical elastic element; 50. friction sleeve; 60. stopping sleeve; 61. flange; 70. upright post wearing plate; 80. side frame; 10'. body; 20'. friction block; 40'. vertical elastic element; 70'. upright post wearing plate; 80'. side frame; and 90'. slope wearing plate.

DETAILED DESCRIPTION OF THE EMBODIMENTS

The embodiment of the disclosure is described below with reference to the drawings in detail, but the disclosure may be implemented in multiple different manners defined and covered by Claims.

Figure 2:
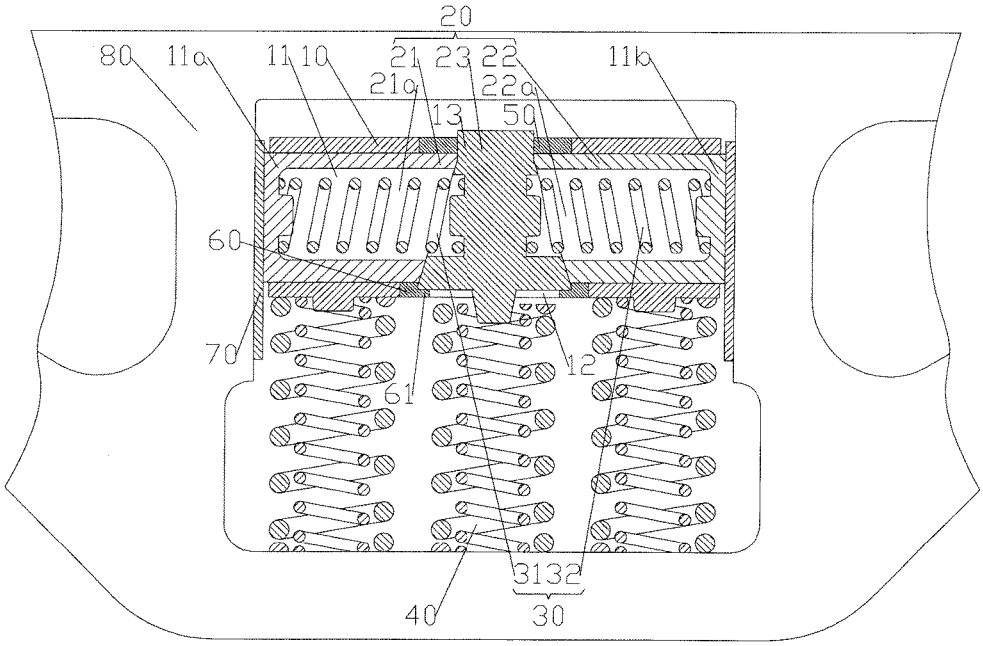
FIG. 2 schematically shows a structure diagram of a bogie in a preferred embodiment of the disclosure.
Figure 3:
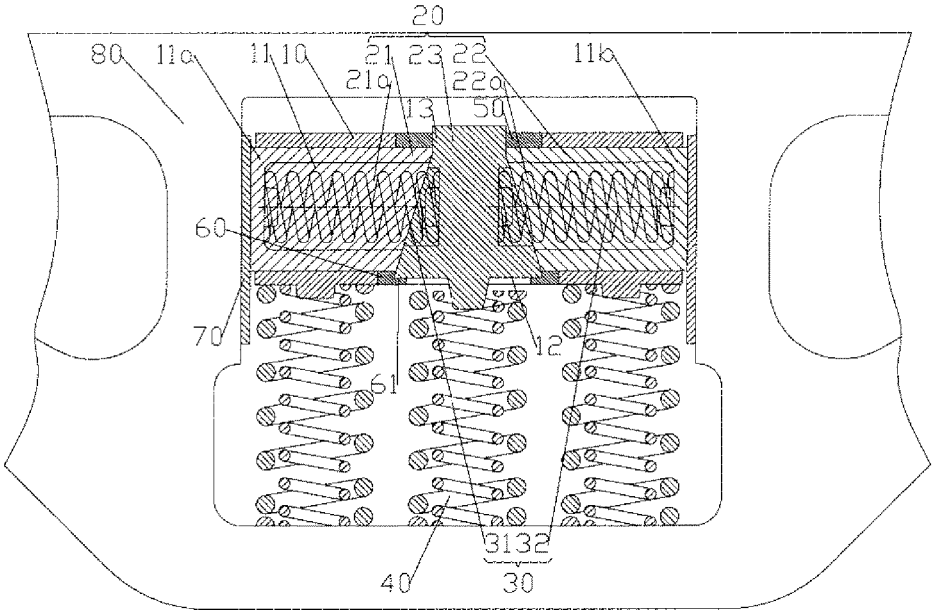
FIG. 3 schematically shows a structure diagram of a bogie in another preferred embodiment of the disclosure.

As a first aspect of the disclosure, a swing bolster is provided. As shown in FIG. 2 and FIG. 3, the swing bolster comprises a body 10, wherein a mounting cavity 11 for mounting a friction block 20 is formed in two ends of the body 10; the mounting cavity 11 is provided with a first horizontal opening 11*a* and a second horizontal opening 11*b*, which are opposite to each other; and opening directions of the first horizontal opening 11*a* and the second horizontal opening 11*b* are perpendicular to an extending direction of the body 10. When the swing bolster in the disclosure is used, the friction block 20 is mounted in the mounting cavity 11 of the body 10 of the swing bolster, and end parts of the friction block 20 extend out of the first horizontal opening 11*a* and second horizontal opening 11*b* of the mounting cavity 11. The friction block 20 is not matched with the swing bolster sloped portions, and a movement direction of the swing bolster is perpendicular to a movement direction of the friction block 20 relative to the swing bolster, so that wear of the friction block 20 and the swing bolster is reduced, influence caused by the relative movement or wear of the swing bolster and the friction block 20 to vibration reduction performance of vertical elastic elements 40 is prevented, the vibration reduction effect of a bogie in an unloaded state is ensured, and using reliability of the swing bolster is ensured.

As a second aspect of the disclosure, a swing bolster vibration reduction assembly is provided. As shown in FIG. 2 and FIG. 3, the swing bolster vibration reduction assembly comprises a swing bolster and a vibration reduction unit, wherein the swing bolster is the abovementioned swing bolster; the body 10 of the swing bolster is provided with a first vertical hole 12, and the first vertical hole 12 is in communication with the mounting cavity 11; the vibration reduction unit comprises a friction block 20, a horizontal elastic element 30 and vertical elastic elements 40; the friction block 20 comprises a first friction block 21, a second friction block 22 and a middle wedge 23; the first friction block 21 is arranged in the mounting cavity 11 of the swing bolster, and a first end of the first friction block 21 extending from a first horizontal opening 11*a* of the mounting cavity 11; the second friction block 22 is arranged in the mounting cavity 11 of the swing bolster, the second friction block 22 is positioned in an extending direction of the first friction block 21, a first end of the second friction block 22 extending from a second horizontal opening 11*b* of the mounting cavity 11, and the horizontal elastic element 30 is arranged between the first friction block 21 and the second friction block 22; the middle wedge 23 is arranged in the mounting cavity 11 of the swing bolster, the middle wedge 23 is positioned between the first friction block 21 and the second friction block 22, the middle wedge 23 is matched with the first friction block 21 and the second friction block 22 sloped portions, and a bottom end of the middle wedge 23 extending from the first vertical hole 12; and there are multiple vertical elastic elements 40, the multiple vertical elastic elements 40 are arranged below the swing bolster, and at least one vertical elastic element 40 is positioned under the bottom end of the middle wedge 23. Preferably, the vertical elastic elements 40 are springs. Of course, in order to prevent wear of the friction block 20 and the swing bolster, a wearing sleeve may be mounted between the friction block 20 and the swing bolster.

In the embodiments as shown in FIG. 2 and FIG. 3, the first friction block 21 and the second friction block 22 are both arranged in the mounting cavity 11, and movement directions of the first friction block 21 and the second friction block 22 relative to the swing bolster are perpendicular to the movement direction of the swing bolster body, and then when the swing bolster moves, acting directions of the vertical elastic elements 40 are perpendicular to the movement directions of the first friction block 21 and the second friction block 22, so that the influence of the movement of the first friction block 21 and the second friction block 22 on the vibration reduction effect of the vertical elastic elements 40 is eliminated, and the swing bolster vibration reduction assembly is further endowed with the characteristic of good vibration reduction effects during unloaded running.

In the embodiments as shown in FIG. 2 and FIG. 3, the horizontal elastic element 30 is arranged between the first friction block 21 and the second friction block 22, so that there always exists pressing force for keeping the first friction block 21 and the second friction block 22 far away from each other between the first friction block 21 and the second friction block 22, and when the swing bolster vibration reduction assembly is mounted at a certain fixed position, the swing bolster vibration reduction assembly is endowed with certain damping force under the action of stable pressing force of the first friction block 21 and the second friction block 22 in the horizontal direction and at the fixed position, and the movement reliability of the swing bolster vibration reduction assembly is ensured.

In the embodiments as shown in FIG. 2 and FIG. 3, the bottom end of the middle wedge 23 extending from the first vertical hole 12, and at least one vertical elastic element 40 is positioned under the bottom end of the middle wedge 23, so that when the swing bolster moves downwards, the middle wedge 23 is driven by the swing bolster to move together, and the vertical elastic element 40 is pressed downwards by the middle wedge 23 to realize a vibration reduction function. Preferably, a circular naval for limiting the displacement of the vertical elastic elements 40 is arranged at the bottom end of the middle wedge 23. The middle wedge 23 is matched with the first friction block 21 and the second friction block 224 sloped portions, so that when the swing bolster moves, acting force between the middle wedge 23 and each of the first friction block 21 and the second friction block 22 may be changed along with the weight of a load, and the swing bolster vibration reduction assembly always has enough damping force.

In an example of the bogie, it should be noted that it is necessary to ensure a certain gap between the middle wedge 23 and each of the first friction block 21 and the second friction block 22 during unloaded running to ensure the reliable running of the swing bolster vibration reduction assembly because an empty vehicle is more lightly loaded and a heavy vehicle is excessively loaded, and then the first friction block 21 and the second friction block 22 are pressed against upright post wearing plates 70 through the horizontal elastic element 30 to ensure stable damping force of the system; and during loaded running, the horizontal elastic element 30 cannot independently provide enough damping force, and then it is necessary to rigidly press the middle wedge 23 against the first friction block 21 and the second friction block 22 to provide stable and reliable damping force. When the swing bolster downwards presses to a certain extent, the vertical elastic element 40 positioned under the bottom end of the middle wedge 23 jacks the middle wedge 23 to make the middle wedge 23 rigidly contact with the first friction block 21 and the second friction block 22, thereby ensuring stable pressing force and stable damping force. Since the middle wedge 23 rigidly contacts with the first friction block 21 and the second friction block 22, when the load is further increased, the acting force between the middle wedge 23 and each of the first friction block 21 and the second friction block 22 may be increased to ensure that the swing bolster vibration reduction assembly can effectively reduce vibration even when bearing a heavy load and ensure the vibration reduction reliability of the swing bolster vibration reduction assembly. Meanwhile, after the middle wedge 23 is rigidly pressed against the first friction block 21 and the second friction block 22, the three may not move relatively along with the movement of the swing bolster, so that wear between each part is reduced, the service life of each part is prolonged, the movement stability and vibration reduction reliability of the swing bolster vibration reduction assembly are ensured, and the using reliability of the swing bolster vibration reduction assembly is improved.

In the embodiment as shown in FIG. 2, the horizontal elastic element 30 comprises a first horizontal elastic element 31 and a second horizontal elastic element 32, wherein the first horizontal elastic element 31 is arranged between the first friction block 21 and the middle wedge 23 in a pressing manner, and the second horizontal elastic element 32 is arranged between the second friction block 22 and the middle wedge 23 in the pressing manner. Due to the arrangement of the first horizontal elastic element 31 and the second horizontal elastic element 32, the acting force and movement reliability of the first friction block 21 and the second friction block 22 are ensured, and the using reliability of the swing bolster vibration reduction assembly is ensured. Preferably, a second circular naval for limiting the displacement of the first horizontal elastic element 31 and the second horizontal elastic element 32 is arranged on the middle wedge 23.

In the embodiment as shown in FIG. 3, the body 10 of the swing bolster is provided with a pressing plate, the pressing plate is arranged in the mounting cavity 11, the pressing plate and the middle wedge 23 are arranged at an interval, and the horizontal elastic element 30 comprises a first horizontal elastic element 31 and a second horizontal elastic element 32, wherein the first horizontal elastic element 31 is arranged between the first friction block 21 and the pressing plate in the pressing manner, and the second horizontal elastic element 32 is arranged between the second friction block 22 and the pressing plate in the pressing manner. Due to the arrangement of the first horizontal elastic element 31 and the second horizontal elastic element 32, the acting force and movement reliability of the first friction block 21 and the second friction block 22 are ensured, and the using reliability of the swing bolster vibration reduction assembly is ensured. Preferably, a circular naval for limiting the displacement of the first horizontal elastic element 31 and the second horizontal elastic element 32 is arranged on the pressing plate.

In the embodiments as shown in FIG. 2 and FIG. 3, the first friction block 21 is provided with a first accommodation cavity 21*a*, an opening of the first accommodation cavity 21*a* faces the second friction block 22, and at least a part of the first horizontal elastic element 31 is positioned in the first accommodation cavity 21*a*; and the second friction block 22 is provided with a second accommodation cavity 22*a*, an opening of the second accommodation cavity 22*a* faces the first friction block, and at least a part of the second horizontal elastic element 32 is positioned in the second accommodation cavity 22*a*. the first horizontal elastic element 31 and the second horizontal elastic element 32 are correspondingly arranged in the first accommodation cavity 21*a* of the first friction block 21 and the second accommodation cavity 22*a* of the second friction block 22 respectively, so that the arrangement stability of the first horizontal elastic element 31 and the second horizontal elastic element 32 is ensured, the movement reliability of the first friction block 21 and the second friction block 22 is ensured, and the using reliability of the swing bolster vibration reduction assembly is further ensured.

Preferably, the first horizontal elastic element 31 and the second horizontal elastic element 32 are springs. Further, there are multiple first horizontal elastic elements 31 and multiple second horizontal elastic elements 32. Furthermore, the first horizontal elastic elements 31 and the second horizontal elastic elements 32 are horizontally or approximately horizontally mounted.

In the embodiments as shown in FIG. 2 and FIG. 3, the body 10 of the swing bolster is provided with a second vertical hole 13, the second vertical hole 13 is in communication with the mounting cavity 11, the second vertical hole 13 and the first vertical hole 12 are coaxially formed, and two ends of the middle wedge 23 are arranged in the first vertical hole 12 and the second vertical hole 13 in a sliding manner. The body 10 of the swing bolster is provided with the second vertical hole 13 for the middle wedge 23 to pass, so that the movement reliability of the middle wedge 23 is ensured, and the using reliability and movement reliability of the swing bolster vibration reduction assembly are improved.

In the embodiments as shown in FIG. 2 and FIG. 3, the vibration reduction unit further comprises a friction sleeve 50 and a stopping sleeve 60, wherein the friction sleeve 50 is provided with a first hole for the middle wedge 23 to pass, the friction sleeve 50 is arranged at the second vertical hole 13, and a top end of the middle wedge 23 is connected with the second vertical hole 13 of the swing bolster through the friction sleeve 50 in a sliding manner; the stopping sleeve 60 is provided with a second hole for the middle wedge 23 to pass, the stopping sleeve 60 is arranged at the first vertical hole 12, the bottom end of the middle wedge 23 extending from the second hole of the stopping sleeve 60, and the stopping sleeve 60 is provided with a flange 61 for stopping the middle wedge 23. Due to the arrangement of the friction sleeve 50, the connection reliability of the swing bolster and the middle wedge 23 is ensured, the middle wedge 23 is prevented from swaying in a movement process, and a good guide function is realized. Due to the arrangement of the stopping sleeve 60 with a guide function as well as a function of stopping the middle wedge 23 excessively moving downwards, the using reliability of the swing bolster vibration reduction assembly is improved.

Preferably, the friction sleeve 50 and the stopping sleeve 60 may form a split structure as well as an integrated structure with the swing bolster. When the friction sleeve 50 and the stopping sleeve 60 form a split structure with the swing bolster, interference fit, bolt connection or the like should be adopted; and when the friction sleeve 50 and the stopping sleeve 60 form an integrated structure with the swing bolt, welding connection may be adopted.

Preferably, the middle wedge 23 is of a wedge-shaped structure. Of course, the middle wedge 23 may also be of a conical structure, a parabolic structure, a partially spherical structure or the like.

In the embodiments as shown in FIG. 2 and FIG. 3, the vibration reduction unit further comprises upright post wearing plates 70, there are two upright post wearing plates 70, the upright post wearing plates 70 are fixedly arranged, one upright post wearing plate 70 of the two upright post wearing plates 70 is pressed against a first end of the first friction block 21, and the other upright post wearing plate 70 of the two upright post wearing plates 70 is pressed against the first end of the second friction block 22. Due to the arrangement of the upright post wearing plates 70, damping force between each of the first friction block 21 and the second friction block 22 and the upright post wearing plates 70 is increased, and the using reliability of the swing bolster vibration reduction assembly is ensured.

The swing bolster vibration reduction assembly in the disclosure has the characteristic of slight influence of wear on the vibration reduction performance (particularly under the unloaded condition), and meanwhile, the space for the arrangement of the vertical elastic elements 40, particularly the space for the arrangement of the vertical elastic elements 40 directly contacting with the swing bolster, below the swing bolster is enlarged.

As a third aspect of the disclosure, a bogie is provided. As shown in FIG. 2 and FIG. 3, the bogie comprises a side frame 80 and a swing bolster vibration reduction assembly, wherein the swing bolster vibration reduction assembly is arranged on the side frame 80, and the swing bolster vibration reduction assembly is the abovementioned swing bolster vibration reduction assembly. Preferably, the upright post wearing plates 70 are arranged on the side frame 80, and the upright post wearing plates 70 are positioned in extending directions of the first friction block 21 and the second friction block 22. In a running process of the bogie in the disclosure, particularly in an unloaded running process, the performance of the swing bolster vibration reduction assembly may not be influenced by the relative movement of the swing bolster and the friction block 20, so that the movement stability of the bogie is ensured, and the using reliability of the bogie is improved.

Under unloaded condition, the horizontal elastic element 30 has a certain compression amount, and the horizontal displacement and downward displacement of the middle wedge 23 are limited by the stopping sleeve 60, so that certain pressure is generated between the friction block 20 and the upright post wearing plates 70, and the aim of reducing the vibration and impact of the vehicle is fulfilled.

Under a heavily-loaded condition, the swing bolster moves downwards, the middle wedge 23 contacts with the vertical elastic elements 40 to compress the vertical elastic elements 40, and then the vertical elastic elements 40 generate counterforce on the middle wedge 23, so that the middle wedge 23 generates acting force on the friction block 20 to generate certain pressure between the friction block 20 and the upright post wearing plates 70, and the vertical elastic elements 40 are compressed to fulfil the aim of reducing the vibration and impact of the vehicle.

The above is only the preferred embodiment of the disclosure and not intended to limit the disclosure, and for those skilled in the art, the disclosure may have various modifications and variations. Any modifications, equivalent replacements, improvements and the like made within the spirit and principle of the disclosure shall be included in the scope of protection of the disclosure.

What is claimed is:

1. A swing bolster vibration reduction assembly, comprising a swing bolster and a vibration reduction unit, wherein the swing bolster comprises a body (10), wherein a mounting cavity (11) for mounting a friction block (20) is formed in two ends of the body (10); the mounting cavity (11) is provided with a first horizontal opening (11*a*) and a second horizontal opening (11*b*), which are opposite to each other; and opening directions of the first horizontal opening (11*a*) and the second horizontal opening (11*b*) are perpendicular to an extending direction of the body (10); the body (10) of the swing bolster is provided with a first vertical hole (12), and the first vertical hole (12) is in communication with the mounting cavity (11); the vibration reduction unit comprises the friction block (20), a horizontal elastic element (30) and vertical elastic elements (40); the friction block (20) comprises:

a first friction block (21), the first friction block (21) being arranged in the mounting cavity (11) of the swing bolster, a first end of the first friction block (21) extending from the first horizontal opening (11*a*) of the mounting cavity (11);

a second friction block (22), the second friction block (22) being arranged in the mounting cavity (11) of the swing bolster, the second friction block (22) being positioned in an extending direction of the first friction block (21), a first end of the second friction block (22) extending from the second horizontal opening (11*b*) of the mounting cavity (11), the horizontal elastic element (30) being arranged between the first friction block (21) and the second friction block (22);

a middle wedge (23), the middle wedge (23) being arranged in the mounting cavity (11) of the swing bolster, the middle wedge (23) being positioned between the first friction block (21) and the second friction block (22), the middle wedge (23) being matched with the first friction block (21) and the second friction block (22) through sloped portions of the first friction block and the second friction block, a bottom end of the middle wedge (23) extending from the first vertical hole (12); and wherein the vertical elastic elements (40) are arranged below the swing bolster, and at least one vertical elastic element (40) is positioned under the bottom end of the middle wedge (23) so that when the swing bolster presses down, the at least one vertical elastic element (40) positioned under the bottom end of the middle wedge (23) urges the middle wedge (23) upward in rigid contact the sloped portions of the first friction block (21) and the second friction block (22).

2. The swing bolster vibration reduction assembly according to claim 1, wherein a diameter of the first vertical hole (12) is greater than a diameter of a second vertical hole (13).

3. The swing bolster vibration reduction assembly according to claim 1, wherein the horizontal elastic element (30) comprises:

a first horizontal elastic element (31), the first horizontal elastic element (31) being arranged between the first friction block (21) and the middle wedge (23) in a pressing manner; and a second horizontal elastic element (32), the second horizontal elastic element (32) being arranged between the second friction block (22) and the middle wedge (23) in a pressing manner.

4. The swing bolster vibration reduction assembly according to claim 3, wherein the first friction block (21) is provided with a first accommodation cavity (21*a*), an opening of the first accommodation cavity (21*a*) faces the second friction block (22), and at least a part of the first horizontal elastic element (31) is positioned in the first accommodation cavity (21*a*); and the second friction block (22) is provided with a second accommodation cavity (22*a*), an opening of the second accommodation cavity (22*a*) faces the first friction block (21), and at least a part of the second horizontal elastic element (32) is positioned in the second accommodation cavity (22*a*).

5. The swing bolster vibration reduction assembly according to claim 1, wherein the body (10) of the swing bolster is provided with a second vertical hole (13), the second vertical hole (13) is in communication with the mounting cavity (11), the second vertical hole (13) and the first vertical hole (12) are coaxially formed, and two ends of the middle wedge (23) are arranged in the first vertical hole (12) and the second vertical hole (13) in a sliding manner.

6. The swing bolster vibration reduction assembly according to claim 5, wherein the vibration reduction unit further comprises:

a friction sleeve (50), the friction sleeve (50) being provided with a first hole for the middle wedge (23), the friction sleeve (50) being arranged at the second vertical hole (13), a top end of the middle wedge (23) being connected with the second vertical hole (13) of the swing bolster through the friction sleeve (50) in a sliding manner; and a stopping sleeve (60), the stopping sleeve (60) being provided with a second hole for the middle wedge (23), the stopping sleeve (60) being arranged at the first vertical hole (12), the bottom end of the middle wedge (23) extending from the second hole of the stopping sleeve (60), the stopping sleeve (60) being provided with a flange (61) for stopping the middle wedge (23).

7. The swing bolster vibration reduction assembly according to claim 1, wherein the vibration reduction unit further comprises two upright post wearing plates (70), the upright post wearing plates (70) are fixedly arranged, one upright post wearing plate (70) of the two upright post wearing plates (70) is pressed against the first end of the first friction block (21), and the other upright post wearing plate (70) of the two upright post wearing plates (70) is pressed against the first end of the second friction block (22).

8. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 1.

9. The swing bolster vibration reduction assembly according to claim 1, wherein the first friction block (21) is provided with a first accommodation cavity (21*a*), an opening of the first accommodation cavity (21*a*) faces the second friction block (22), and at least a part of the first horizontal elastic element (31) is positioned in the first accommodation cavity (21*a*); and the second friction block (22) is provided with a second accommodation cavity (22*a*), an opening of the second accommodation cavity (22*a*) faces the first friction block (21), and at least a part of the second horizontal elastic element (32) is positioned in the second accommodation cavity (22*a*).

10. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 3.

11. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 1.

12. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 4.

13. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 5.

14. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 6.

15. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 7.

16. A bogie, comprising a side frame (80) and a swing bolster vibration reduction assembly, wherein the swing bolster vibration reduction assembly is arranged on the side frame (80), and the swing bolster vibration reduction assembly is the swing bolster vibration reduction assembly according to claim 2.

* * * * *